US005598673A

United States Patent [19]

Atkins

[11] Patent Number: 5,598,673

[45] Date of Patent: Feb. 4, 1997

[54] MASONRY CAVITY WALL AIR SPACE AND WEEPS OBSTRUCTION PREVENTION SYSTEM

[76] Inventor: Mark R. Atkins, 2598 Stagecoach Trail S., Afton, Minn. 55001

[21] Appl. No.: 182,647

[22] Filed: Jan. 18, 1994

[51] Int. Cl.[6] ..... E04B 1/41; E04B 1/70

[52] U.S. Cl. ..... 52/302.1; 52/378; 52/379; 52/426; 52/302.3

[58] Field of Search ..... 52/302.1, 302.3, 52/381, 383, 424, 426, 378, 379, 404.2

[56] References Cited

U.S. PATENT DOCUMENTS

| | | | |
|---|---|---|---|
| 1,616,977 | 2/1927 | Koivu | 52/426 |
| 1,951,421 | 3/1934 | Kleitz | 52/379 |
| 1,954,730 | 4/1934 | Erickson . | |
| 2,147,035 | 2/1939 | Henderson . | |
| 2,213,355 | 9/1940 | Woodworth . | |
| 2,298,319 | 10/1942 | Vatet . | |
| 2,329,585 | 9/1943 | Brewer . | |
| 2,634,601 | 4/1953 | Tillery . | |
| 2,705,887 | 4/1954 | Xanten . | |
| 2,856,766 | 9/1958 | Huntley | 52/378 |
| 2,934,931 | 5/1960 | Johnson . | |
| 3,287,866 | 11/1966 | Bevilacqua . | |
| 3,293,810 | 12/1966 | Cox et al. . | |
| 3,668,829 | 6/1972 | Nelson . | |
| 3,772,840 | 11/1973 | Hala . | |
| 3,852,925 | 12/1974 | Gazzo . | |
| 3,999,349 | 12/1976 | Miele et al. . | |
| 4,129,972 | 12/1978 | Sherman et al. | 52/302.3 |
| 4,224,773 | 9/1980 | Schwörer . | |
| 4,282,691 | 8/1981 | Risdon . | |
| 4,333,281 | 6/1982 | Scarfone . | |
| 4,373,314 | 2/1983 | Allan | 52/379 X |
| 4,381,630 | 5/1983 | Koester . | |
| 4,422,271 | 12/1983 | Anzinger . | |
| 4,486,968 | 12/1984 | Cosenza . | |
| 4,612,742 | 9/1986 | Bevilacqua . | |
| 4,622,796 | 11/1986 | Aziz et al. . | |
| 4,835,928 | 6/1989 | Scott | 52/426 |
| 4,852,320 | 8/1989 | Ballantyne . | |
| 4,869,043 | 9/1989 | Hatzinikolas et al. | 52/379 X |
| 4,907,385 | 3/1990 | Biodrowski . | |
| 4,910,931 | 3/1990 | Pardue . | |
| 5,230,189 | 7/1993 | Sourlis . | |

OTHER PUBLICATIONS

Masonry Coustruction "Old Problems and New Opportunities" May, 1992 By John A. Koski pp. 169–172.

*Primary Examiner*—Wynn E. Wood
*Attorney, Agent, or Firm*—Larry M. Jennings, P.A.

[57] ABSTRACT

Water damage to buildings which will use masonry cavity wall construction is prevented by placement of a masonry holding fluid conducting medium between the wythes of a masonry cavity wall during construction. The air space of a masonry cavity wall is substantially filled with fluid conducting medium such as a coarse polymer mesh which will hold masonry and prevent construction debris from entering the cavity air space while allowing air and water to flow with minimal resistance. Reliable drainage of moisture from the air space is assured because cavity wall drains or weeps will not become obstructed either during or after wall erection because the potential obstructions are excluded from the cavity air space by the fluid conducting medium. By assuring that the cavity wall air space and weeps do not become obstructed, potentially severe water damage is prevented. Mortar usage will be reduced and productivity increased by use of the mortar holding fluid conducting medium system disclosed by the inventor.

20 Claims, 6 Drawing Sheets

MASONRY CAVITY WALL AIR SPACE AND WEEPS OBSTRUCTION PREVENTION SYSTEM

FIELD OF THE INVENTION

The invention relates to cavity walls, a common type of masonry construction used in commercial and residential buildings. A cavity wall generally has a structurally significant inner "wythe" made of concrete block or other framing materials, and an exterior wythe which is typically non-load bearing made of brick, stone, or other masonry material. Between the wythes is a cavity which provides an air space which must be kept open for the lifetime of the building to allow any accumulation of water to drain and air to circulate. The invention prevents mortar and debris from entering the cavity and blocking the drainage weeps. The likelihood of premature failure of the cavity wall is greatly reduced by using the construction system disclosed herein which prevents the air space and weeps from becoming obstructed during or after building erection.

BACKGROUND AND SUMMARY OF THE INVENTION

In cavity wall construction, an inner wall portion or wythe is usually made of wood or steel framing sheathed with gypsum board or other sheet material, or concrete block. Insulation board is often applied to the outer side of the concrete block or sheathing and ordinary interior finish materials to the interior side of the inner wythe. A second wythe is constructed using the desired exterior finishing material (usually brick) which covers the insulation or sheathing. The facing sides of the two wythes are typically separated two to four inches to form a cavity; the cavity provides an air space and may include insulation.

Regardless of the material used in construction of the wythes, it is essential that an air space be maintained between them; it is also essential to provide a way to remove moisture from the cavity. Drainage holes called "weeps" are normally provided at the first course of brick above grade elevation, at lintels and at other flashings which direct water away from the interior of the building. Moisture can enter the cavity due to condensation, permeation, plumbing faults, roof faults, and cracks in the masonry which inevitably occur over time, among other ways. It is impossible to prevent small amounts of water from penetrating brick or other masonry walls because the materials are porous and prone to cracking. If water accumulates in the cavity between the inner and outer masonry portions of a wall, problems with degradation of the brick, efflorescence, interior damage, and damage to foundations can develop.

A common problem in cavity wall erection is that excess mortar and other construction debris may fall into the cavity and create places where moisture can accumulate. If mortar or other construction debris obstructs the weeps or provides a place where water can pond, the build-up of moisture can damage insulation, carpets, interior wall finishes and furnishings. Efflorescence is another problem resulting from accumulation of water in the wall. In addition, the freezing of accumulated moisture can cause spalling and other damage. A variety of techniques have been attempted to prevent air spaces, vents and weeps from becoming blocked, but none has proven adequate.

One technique to keep the cavity wall air space open is to increase its size. However, that necessarily results in increased foundation size, thicker walls, more expensive window and door installation, and greater labor costs. Other common techniques also have serious drawbacks.

For instance, the cavity is sometimes filled with pea gravel to prevent dropped mortar from filling the weeps. Pea gravel itself will sometimes block the weeps or else simply raise the elevation at which mortar accumulates to the height of the pea gravel. The installation of pea gravel is laborious, especially as the wall increases in height.

Another technique requires construction workers to lift a board through the cavity to dislodge and remove dropped mortar. In the course of lifting a board through the cavity, the board may catch on bricks which have partially set and compromise the integrity of the bond of the mortar to the brick. The technique is also disruptive of the normal work of the mason and is difficult to accomplish when horizontal joint reinforcement materials are incorporated into the wall design.

Another technique is described by Ballantyne in U.S. Pat. No. 4,852,320 and requires the mason to install inclined shapes of sheet or extruded metal within the air space of the cavity wall. In U.S. Pat. No. 5,230,189, Sourlis describes shapes made of polymer mesh for catching mortar debris as it drops into the wall cavity. Although such techniques may represent an improvement over traditional methods, they do not overcome all of the traditional drawbacks. First, the on-site installation is difficult to properly supervise because the components are hidden from view almost immediately after installation. In the event that problems with the installation are discovered, correction is likely to be expensive, perhaps prohibitively so. Second, the techniques and equipment are designed to trap and collect debris. Once collected, that debris could, in some instances, provide locations water may accumulate with the potential for damage to the structure. Another shortcoming of previous attempts to solve the problem is the expense of implementing them. Most are relatively unproven and represent a substantial initial expense to obtain an uncertain benefit.

What is needed, then, is a way to keep excess mortar and other construction debris out of the air space from the very beginning. The present invention meets that need by preventing, from the outset, creation of excess mortar debris which could block the weeps and allow moisture to accumulate, and excluding other debris from the cavity by preventing it from entering in the first place. Not only does the present invention prevent blockage of weeps, it also prevents bridging of masonry ties with mortar. It is expected to reduce construction costs by allowing smaller cavity dimensions which can reduce the cost of foundations and window and door openings. It is especially significant that the present invention is expected to reduce the cost for mortar by reducing waste while increasing productivity. The present invention also allows the specification of smaller air spaces thereby providing space for additional wall insulation and/or smaller foundation sizes.

The present invention is comprised of a continuous fluid conducting medium to assure both that air can circulate in the air space and that water can be safely and reliably removed; the fluid conducting medium believed preferable is a coarse polymer mesh or non-woven fabric. Such a mesh would be analogous to the non-woven materials sometimes used for filtration of air in forced-air furnaces. The fluid conducting medium is not to be water absorbent and must have sufficient rigidity and strength to hold mortar which comes into contact with it until the mortar is set. By holding the mortar in the interstices of the mesh, the fluid conducting medium thereby prevents the mortar from accumulating at the bottom of the cavity wall airspace and causing blockage of weeps. Additionally, mortar and construction debris are precluded from entering the cavity airspace to any potentially troublesome extent by the mesh which extends largely continuously throughout the air space. The fluid conducting medium is preferably attached to extruded polystyrene foam insulation board or equivalent and together with the insulation, substantially fills the air space of the cavity wall.

With or without insulation, the fluid conducting medium is attached to the first wythe (the inner wythe) and disposed within the air space at a distance of approximately ⅛" from the inner surface of the second wythe (the exterior wythe). The mortar expressed from the inner side of the bricks as they are laid will be prevented from falling because it would become entangled in the mesh fibers. The expressed mortar would not extend across all of the distance from between the second wythe and the first wythe whether it is fitted with insulation board or other sheathing material. Thus, an uninterrupted channel will be maintained from the top to the bottom of the wall cavity and throughout the entire length of the wall to assure proper moisture drainage and air circulation. Some design professionals specify installation of vents both at the brick ledge (weeps) and at the top of the wall or below relief angles.

The fluid conducting medium must allow circulation of air and the free drainage of moisture. Although it is preferably fabricated of a polymer mesh, other materials and configurations could be used effectively to achieve an equivalent result. Other configurations which may prove equivalent could include fluid conducting medium made by forming grooves or protrusions on sheets of insulation or other construction materials such as gypsum board. It is possible that the fluid conducting medium may be made of recycled or mixed recycled plastic. Although other techniques may be used to form the fluid conducting medium, it is believed preferable to form a non-woven polymer mesh having a thickness twice that desired. The mesh could then be split to half thickness using a hot-wire cutting device or the like. The resultant comparatively sharp ends may hold expressed mortar more securely than the other side of the mesh.

It is to be understood that, although the fluid conducting medium is preferably bonded to insulation sheet material in the facility where the product is manufactured, it may also be pressed into place at the construction site or affixed using any suitable adhesive. It is anticipated that sheets of fibrous mesh fluid conducting medium could be installed by placing them between the masonry ties. It is further to be understood that the preferred resilience and strength of the material will be sufficient to allow it to hold mortar but also soft enough to permit workers to readily install masonry ties and to otherwise work with it easily.

A further advantage of the invention disclosed herein is that it provides a method for equalizing air pressure throughout the cavity wall. When wind is blowing, the pressure on the down-wind side of the building is less than the pressure on the up-wind side. If the outside of the building is wet, for example due to rain, the existence of any significant pressure differential will cause water to be drawn from the outside of the building through even very small cracks, defects, and other openings in the masonry. The present invention, by preventing any obstruction of the cavity air space vents or the weeps, allows air pressure to equalize at all points on both sides of the outer wythe. The presence of obstructions in the air space or weeps can result in wet spots during rains which can be very difficult to correct.

The invention is expected to improve the overall quality of the constructed building. The expected improvements include reduced re-work, fewer complaints by owners, and longer building life. The cost of the materials used in the invention are offset by savings resulting from reduced mortar waste, reduced foundation size, lower costs to construct window and door openings, reduced costs for steel members such as lintels, and improved productivity. Unlike those approaches intended to collect construction debris which enters the cavity air space, the present invention may lower overall construction costs; that benefit is complemented by easier installation and improved quality of the final product.

The drawing shows a typical installation with brick exterior finish, a clearance space of ⅛", a mesh thickness of ⅜", an insulation layer of 1½", and an interior structural masonry wall of concrete block. In this way, a 2" cavity can provide all benefits of cavity walls having a 4" cavity at a much lower cost. It is believed that the mesh thicknesses most commonly used will be in the range of ⅜" to 1" although other thicknesses could be used in certain applications.

DETAILED DESCRIPTION OF THE DRAWING

Figure 1:
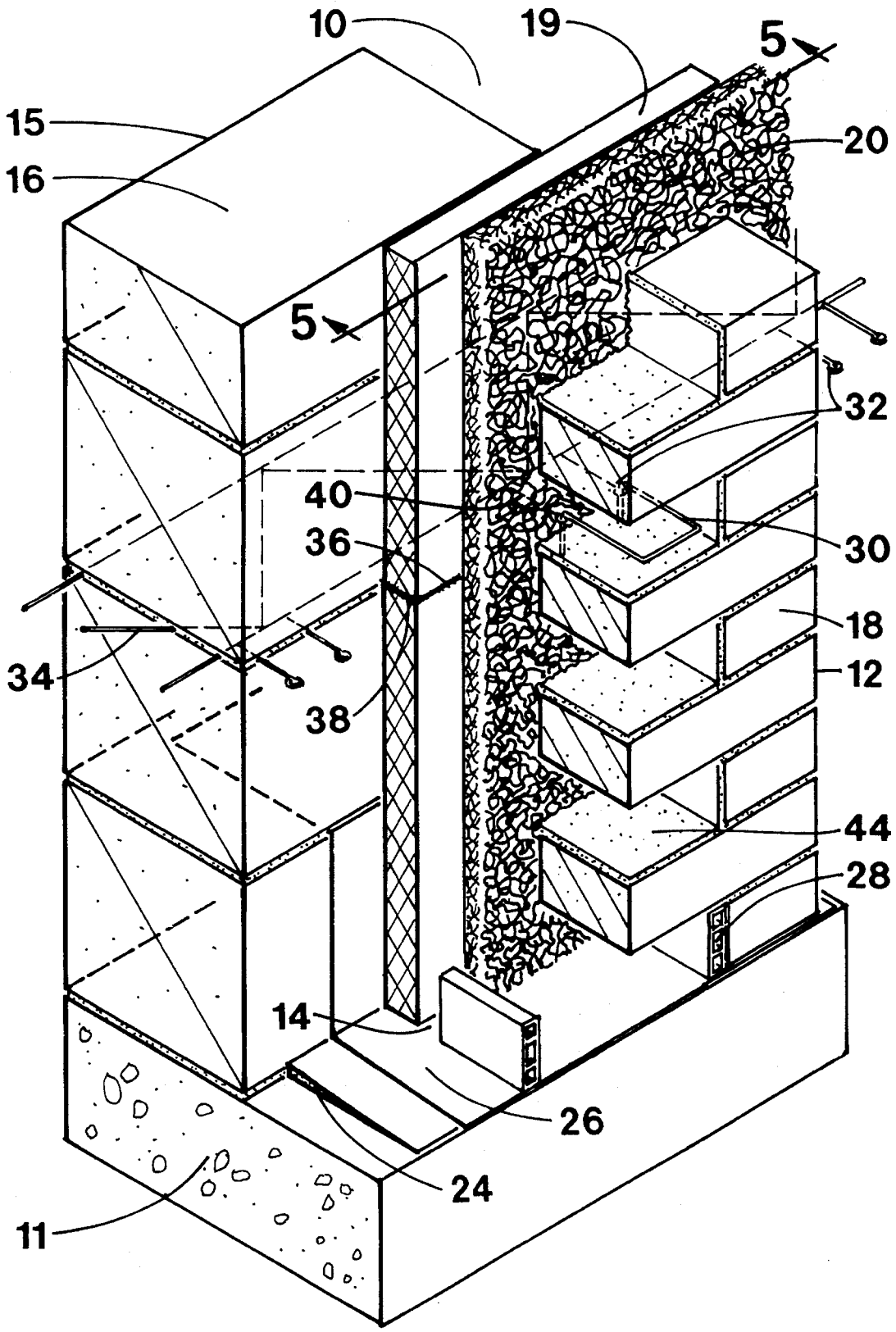
FIG. 1 shows an exploded perspective view of an embodiment of the invention.
Figure 2:
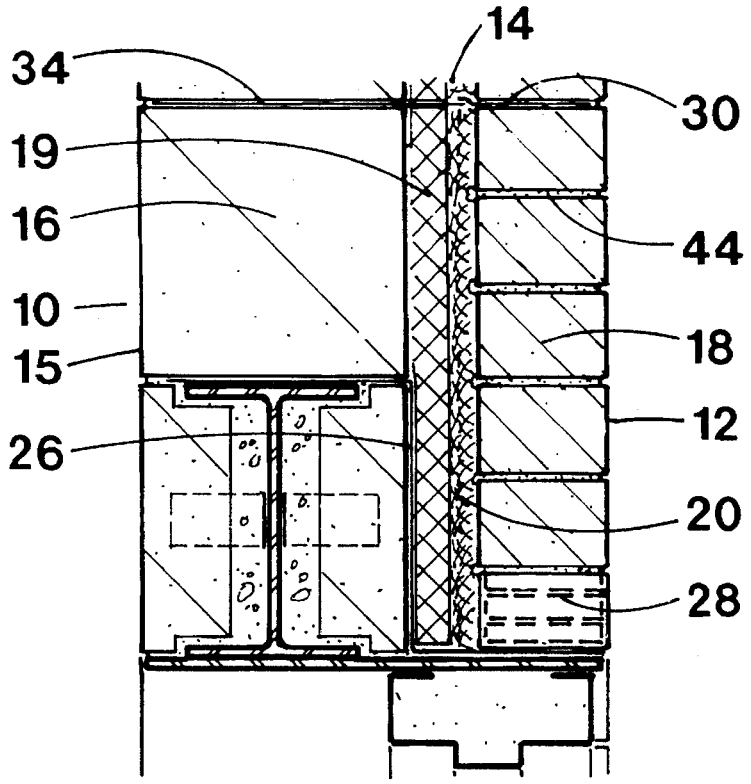
FIG. 2 shows a cross-sectional detail of the embodiment depicted in FIG. 1 wherein the masonry cavity wall terminates at a lintel above a building opening.
Figure 3:
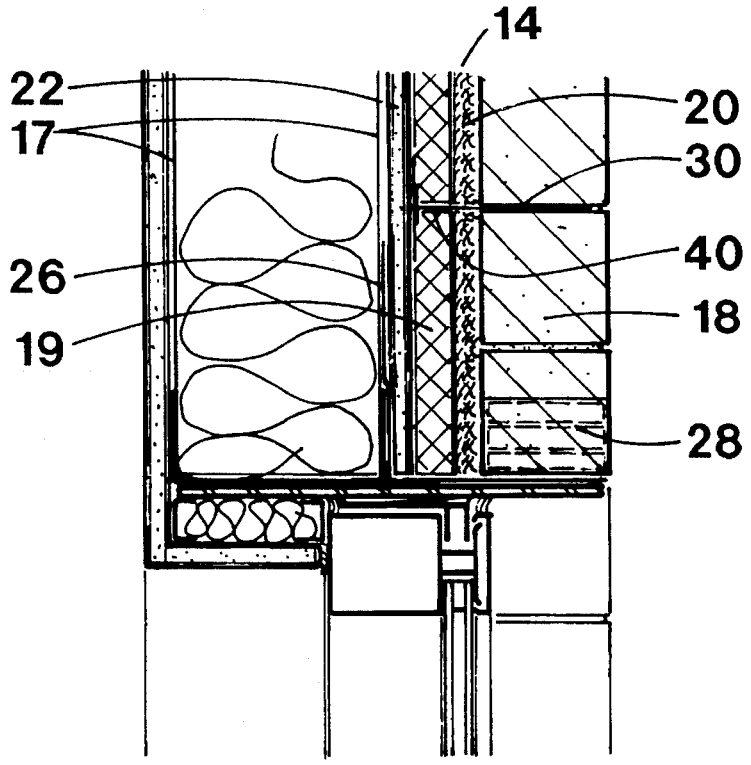
FIG. 3 shows a cross-sectional detail of an embodiment of the invention wherein the inner wythe is a stud structure system.
Figure 5:
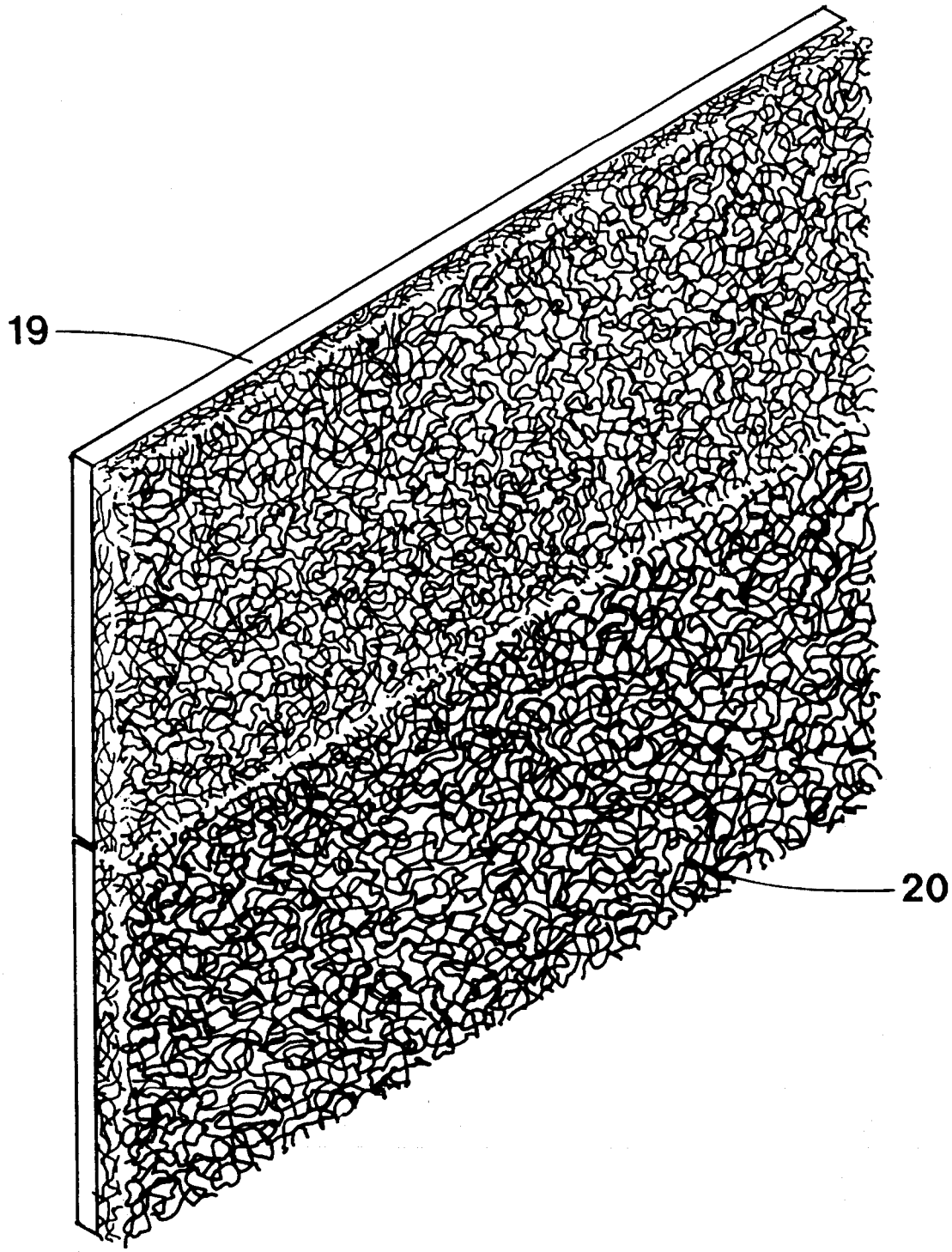
FIG. 5 shows a perspective detail of the embodiment depicted in FIG. 1 taken along line 5—5.
Figure 6:
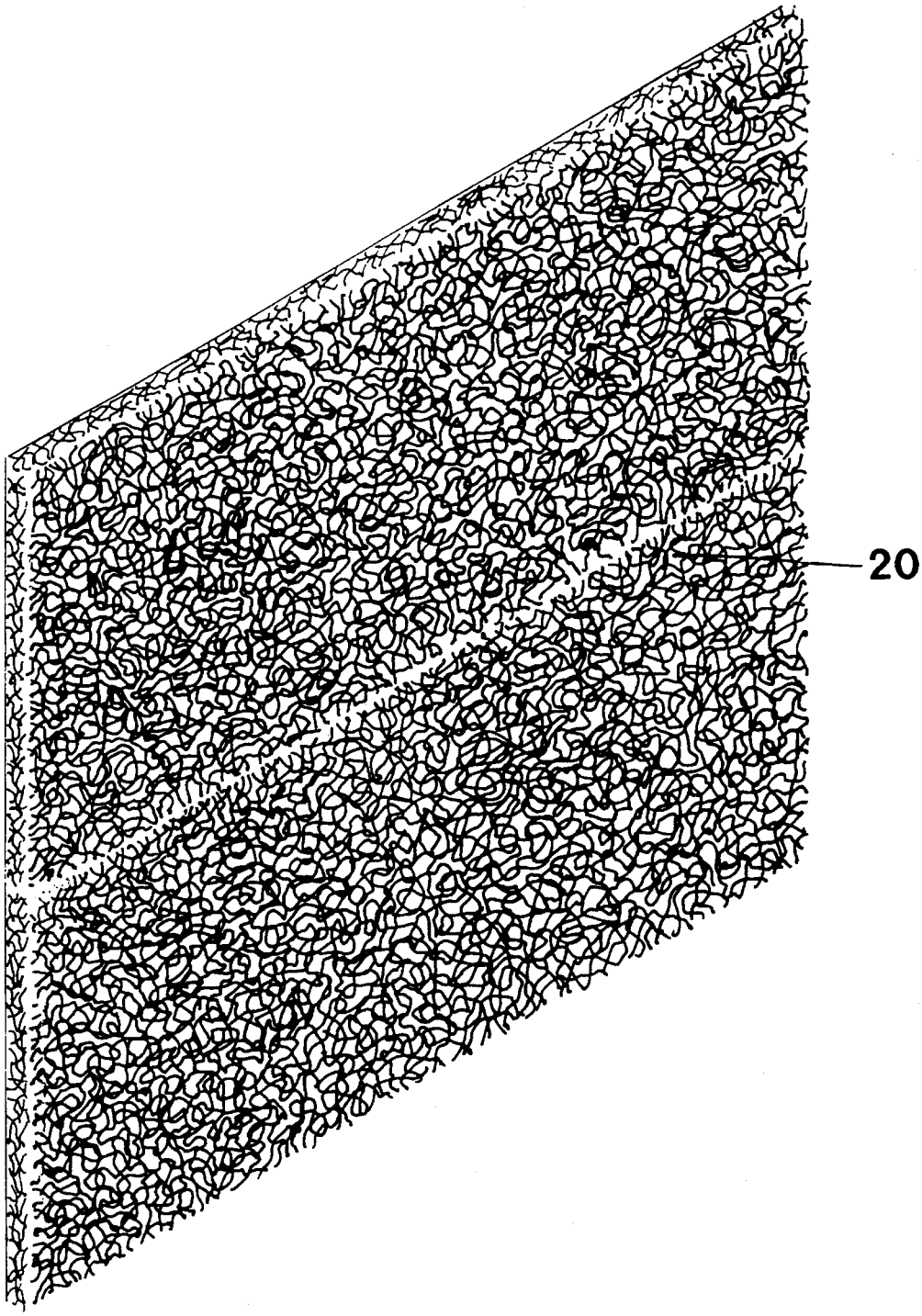
FIG. 6 shows a perspective detail of the embodiment depicted in FIG. 1 taken along line 5—5 wherein the mesh material is not bonded to insulation or other board material.

FIG. 1 shows a masonry cavity wall 10 constructed on a foundation 11 which supports an exterior (or second) wythe 12 separated by an air space 14 from an interior (or first) wythe 15. The interior wythe 15 may be made of concrete block 16 as shown in FIG. 2, wood or steel framing 17 as shown in FIG. 3, or a variety of other materials including, but not limited to, structural clay tile, wood, hollow brick, and concrete. The exterior wythe 12 is preferably made of brick 18 but may be made of other masonry materials including, without limitation, rock, artificial stone, concrete, block, stone, glass, and the like. The cavity air space 14 is provided with board insulation 19 to which is attached a fluid conducting medium 20. This fluid conducting medium 20 is a material which allows gases, including air, and liquids, including water, to pass through it with negligible resistance but generally prevents solid materials from passing through it. The fluid conducting medium 20 is preferably made of fabric mesh bonded to standard extruded styrene foam board insulation 19 as shown in FIG. 5. The fluid conducting medium 20 may also be fabricated, sold, and installed separately as illustrated in FIG. 6. Although the illustrated fluid conducting medium 20 is a coarse mesh, it is to be understood that other equivalent materials and techniques may be used in its fabrication. For example, it could be fabricated by making grooves in the sheathing material, covering grooves in the sheathing material with a fabric mesh, or by placing protrusions or protrusions having thickened portions, on the sheathing material. The fluid conducting medium 20 may be attached to any materials used to construct the first wythe. For example, when the side of the first wythe defining the cavity is made of gypsum board sheathing 22, the fluid conducting medium 20 could be bonded to the gypsum board or to board insulation 19 as shown in FIG. 3.

The wythes are normally constructed to yield a cavity width of two to four inches in order to allow for air circulation and insulation 19 between the wythes; however, the exact dimension of the cavity may vary. Both wythes of the wall 10 normally rest on a single foundation 11 which may be cantilevered or stepped to provide support for the exterior wythe 12. The foundation 11 is normally covered with a mortar cant 24 which slopes downward from the cavity side of the interior wythe 15 to the exterior. A masonry flashing 26 communicating between the interior wythe 15 and the exterior of the wall 10 rests on a mortar cant 24 any moisture in the cavity will drain to the exterior of the wall 10.

Figure 4:
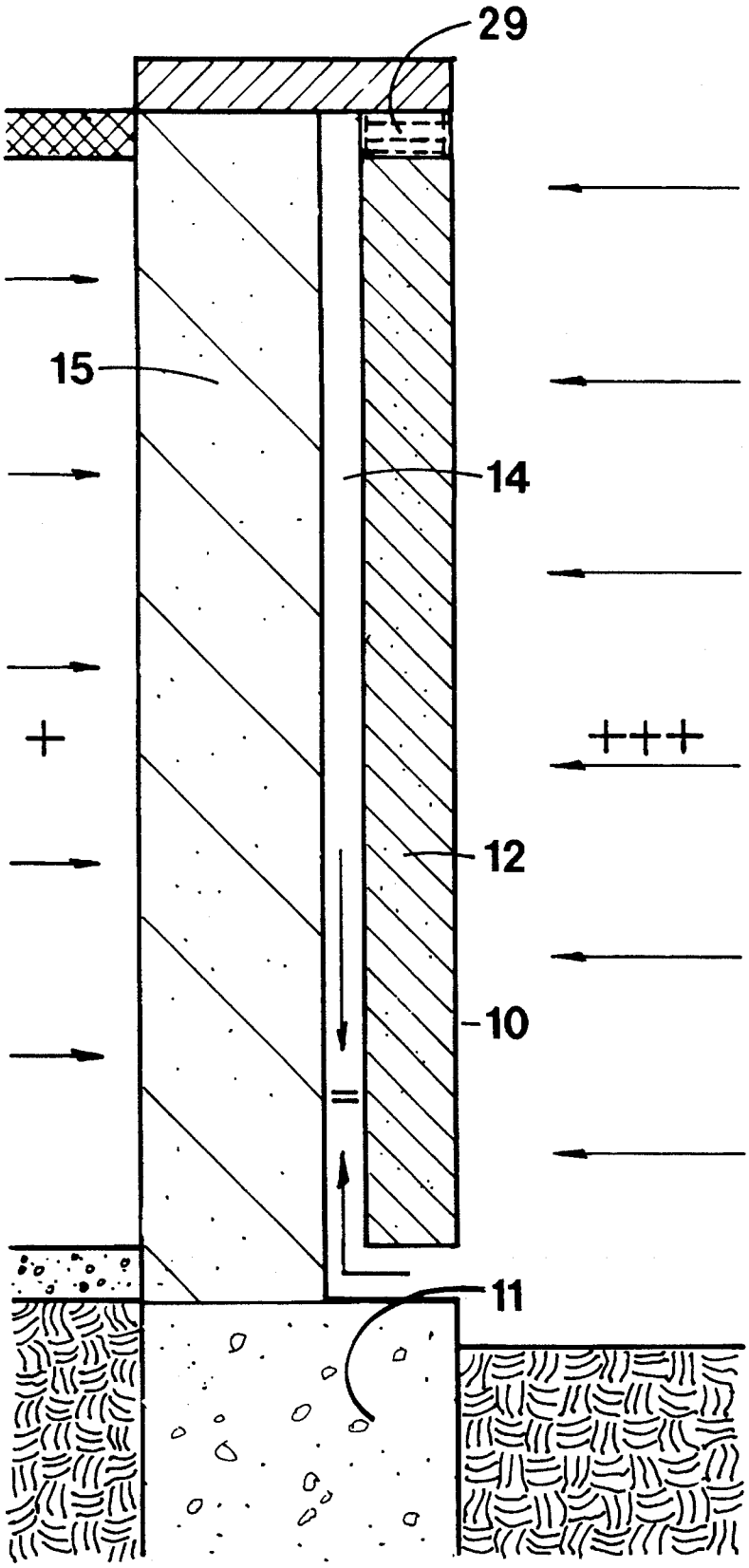
FIG. 4 shows a cross-sectional detail of the embodiment depicted in FIG. 1 wherein the unobstructed air space is more fully illustrated and the air pressure equalization properties of the invention are shown.

Current construction techniques normally provide drainage openings called "weeps" 28 which communicate between the exterior of the wall 10 and the air space 14. Weeps 28 drain moisture from the surface of flashing 26 and provide ventilation of the air space 14. Another benefit of unobstructed ventilating weeps 28 and air spaces is that air pressure is equalized on both sides of the exterior wythe 12 as illustrated in FIG. 4. Some design professionals specify installation of additional vents 29 in the upper part of the exterior wythe 12 to provide greater circulation of air through the air space 14. Weeps 28 may be made using pre-formed plastic devices, cotton wicking, rope, formed sheet metal components, tubing, perforated tubing, or simply by excluding mortar from the head joints of the bricks 18 comprising the first course of bricks in a wall. Weeps 28 and vents 29 may be covered with screen or netting to exclude vermin.

The wythes are secured together with steel masonry ties 30 and attachment eyes 32. The masonry ties 30, eyes 32, and horizontal reinforcing 34 and any other steel components used in construction must be kept free of moisture to prevent rust. If steel components of masonry construction oxidize, expansion results which can, in turn, cause destructive cracking of masonry and loss of structural integrity.

In the usual cavity wall 10 construction, an interior wythe 15 is made of concrete block 16 to which insulation 19 is affixed. Sealant 36 is applied to all joints 38 and penetrations 40 of the insulation board 19 including, for example, those made by the masonry ties 30 and eyes 32.

Figure 7:
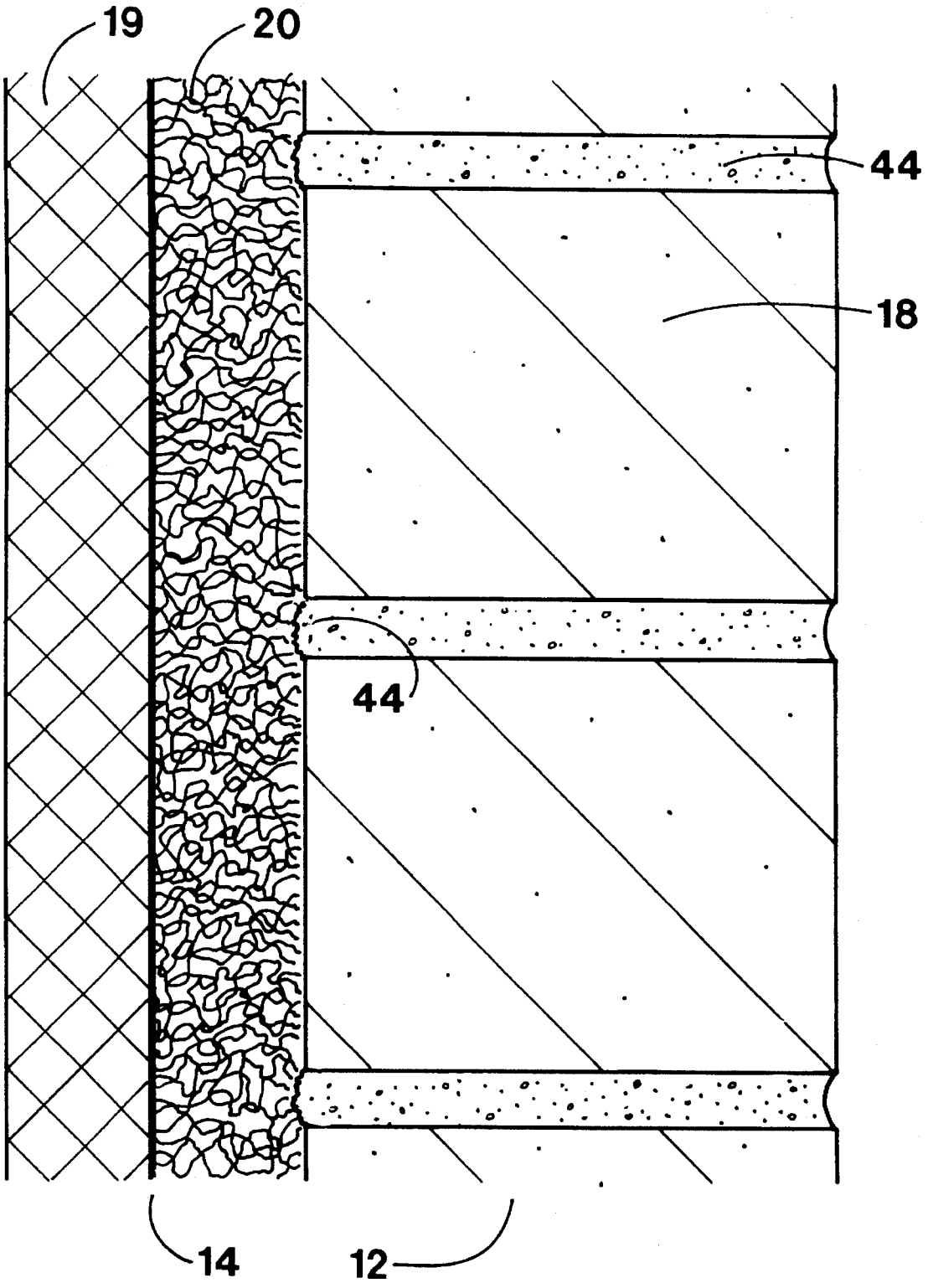
FIG. 7 is a cross-sectional detail showing the mesh holding mortar express from a mortar joint.

The exterior wythe 12 is usually face brick 18 secured in mortar 44. When the brick is laid by the mason, mortar 44 may be expressed from between the bricks. The mason removes excess mortar 44 from the exterior of the brick wythe. The fluid conducting medium 20 holds any mortar 44 expressed from between the bricks in its interstices as shown in FIG. 7. Mortar 44 and other construction debris is thereby prevented from falling into the cavity air space 14 and obstructing it or the weeps 28.

Changes and modifications in the specifically described embodiments can be carried out without departing from the scope of the invention which is intended to be limited only by the scope of the appended claims.

What is claimed is:

1. A cavity wall comprising:

a first wythe;

a second wythe;

air space between said first wythe and said second wythe;

means for removing water from said air space;

a fluid conducting medium disposed proximate to said second wythe, said fluid conducting medium substantially filling said air space, and having the additional properties of;

allowing air, water and water vapor to flow readily through said fluid conducting medium:

resisting the flow of mortar, and;

holding during construction of said second wythe substantially all mortar proximate to masonry joints from which said mortar may be expressed toward said air space.

2. The invention according to claim 1 wherein:

said mortar-holding fluid conducting medium is comprised of fibrous mesh material affixed to the surface of said first wythe;

said mesh material has void volume exceeding fifty percent;

said mesh material resists absorption of water: and;

fluid-conducting passages are formed within said air space by said mesh material.

3. The invention according to claim 2 wherein said mortar-holding fluid conducting medium is comprised of fibrous mesh material having an inner surface and an outer surface, said inner surface being proximate to said first wythe and the outer surface being proximate to said second wythe.

4. The invention according to claim 3 wherein:

said mesh material is comprised of water resistant polymer fibers.

5. The invention according to claim 4 wherein said fluid-conducting medium is affixed to one of the structural materials included in the group comprised of insulation board, gypsum board, insulation panels, gypsum panels, sheathing panels, concrete block, structural tile, plywood, waferboard, particle board, and composition board.

6. The invention according to claim 5 wherein said fibrous mesh;

has a nominal thickness in the range of ⅛" to 4";

is comprised of non-woven polymer fibers, and;

is attached to said structural materials have nominal thicknesses of between ¼" and 12".

7. The invention according to claim 1 wherein said fluid conducting medium is affixed to structural material included in the group of materials comprised of insulation board, gypsum board, insulation panels, gypsum panels, sheathing panels, plywood, waferboard, particle board, and composition board, said structural material having an inner surface and an outer surface, the inner surface being disposed within said air space proximate to the surface of said first wythe, and the outer surface of said structural material being attached to said fluid conducting medium.

8. The invention according to claim 7 wherein said fluid-conducting passages are comprised of fibrous mesh affixed to said structural material.

9. The invention according to claim 8 wherein said structural material is insulating board, and said fluid conducting medium covers substantially all of the outer surface of said insulating board.

10. The invention according to claim 9 further comprising:

a flashing which communicates from said first wythe across said air space through said second wythe;

means for affixing said flashing to said first wythe between said first wythe and said fibrous mesh, and;

means for draining water from the upper surface of said flashing through said second wythe, said draining means affixed proximate to said flashing.

11. The invention according to claim 10 wherein:

said air space is substantially filled by said insulating material and said fibrous mesh.

12. The invention according to claim 11 wherein:

said fibrous mesh is comprised of non-woven polymer material having a nominal thickness of between ⅛" and 4" and;

said insulating material is comprised of extruded polymer foam having a nominal thickness of between ¼" and 6".

13. A method for constructing a masonry cavity wall comprising the steps of:

constructing a foundation capable of supporting a first wythe and a second wythe separated by an intermediate air space;

constructing a first wythe;

affixing holding means to said first wythe for holding excess mortar and other debris which become disposed toward said air space;

constructing a second wythe having weeps situate therein which communicate between said air space and the outside of said second wythe, and;

holding with said holding means mortar expressed within said air space during construction of said second wythe.

14. Apparatus for preventing obstruction of a masonry cavity wall of the type having an inner wythe and an outer wythe separated by an air space comprising:

a fiberous mesh mat fluid conducting medium having a first side and a second side and a thickness sufficient to substantially fill said air space of said masonry cavity wall, means for securing said fluid conducting medium to the cavity side of the inner wythe of a masonry cavity wall;

a flashing interposed between said fluid conducting medium and said inner wythe, said flashing extending from said inner wythe to the exterior of said outer wythe substantially continuously along said cavity wall;

weeps communicating through said outer wythe disposed above and proximate to said flashing.

15. The apparatus of claim 14 wherein:

said fluid conducting medium is comprised of fibrous polymer mesh having a void space exceeding fifty percent.

16. The apparatus of claim 15 wherein:

said fluid conducting medium is adapted for holding mortar and debris on one face thereby preventing mortar used during construction of the second wythe both from falling into the air space and from penetrating more than half way through said fluid conducting medium.

17. A method for preventing water damage to a masonry cavity wall comprising the steps of:

constructing a foundation capable of supporting a first wythe and a second wythe separated by an intermediate air space;

constructing a first wythe;

affixing holding means to said first wythe for holding excess mortar and other debris which become disposed toward said air space;

constructing a second wythe having weeps situate therein which communicate between said air space and the exterior of said second wythe; and holding with said holding means mortar expressed within said air space during construction of said second wythe.

18. A method for equalization of static pressure within the air space and the exterior of a masonry cavity wall comprising the steps of:

constructing a foundation capable of supporting a first wythe and a second wythe separated by an intermediate air space;

constructing a first wythe;

affixing holding means to said first wythe for holding excess mortar and debris which become disposed toward said air space;

constructing a second wythe having weeps that communicate between said air space and the exterior of said second wythe, and;

holding with said holding means mortar expressed within said air space during construction of said second wythe.

19. The method of claim 18 further comprising the step of:

constructing, within the upper portion of said wall, a vent which communicates between said air space and the exterior of said second wythe.

20. A cavity wall comprising:

a first wythe;

a second wythe;

an air space between said first wythe and said second wythe;

means for removing water from said air space;

holding means for holding mortar which enters said air space during construction of said second wythe proximate to the masonry joints from which said mortar may be expressed;

said holding means is comprised of fluid conducting medium through which water and air can flow;

said holding means substantially fills said air space;

said holding means is disposed proximate and parallel to said second wythe;

said fluid conducting medium is comprised of fibrous mesh material affixed to the surface of said first wythe;

said mesh material has an open area exceeding fifty percent;

said mesh material resists absorption of water; and fluid-conducting passages are formed within said air space by said mesh material.

* * * * *